US008069790B1

(12) United States Patent
Melkers

(10) Patent No.: US 8,069,790 B1
(45) Date of Patent: Dec. 6, 2011

(54) METHODS AND APPARATUS FOR ATTACHMENT ADAPTER FOR A PROJECTILE

(75) Inventor: Edgar R. Melkers, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 471 days.

(21) Appl. No.: 12/135,371

(22) Filed: Jun. 9, 2008

Related U.S. Application Data

(60) Provisional application No. 60/943,001, filed on Jun. 8, 2007.

(51) Int. Cl.
*C06C 5/00* (2006.01)

(52) U.S. Cl. ..... 102/275.9

(58) Field of Classification Search ..... 102/520–522, 102/221, 275.9
See application file for complete search history.

(56) References Cited

U.S. PATENT DOCUMENTS

| | | | | | |
|---|---|---|---|---|---|
| 918,560 | A * | 4/1909 | Lanneau | 102/200 |
| 1,531,716 | A * | 3/1925 | Remondy | 102/272 |
| 3,054,646 | A * | 9/1962 | Minor | 175/325.6 |
| 3,374,632 | A | 3/1968 | Donovan | |
| 3,440,963 | A * | 4/1969 | De Luca | 102/513 |
| 3,670,656 | A * | 6/1972 | Donahue et al. | 102/228 |
| 4,205,608 | A * | 6/1980 | Nicolaides et al. | 102/200 |
| 4,326,463 | A * | 4/1982 | Burke et al. | 102/513 |
| 4,500,051 | A | 2/1985 | Cottle, Jr. et al. | |
| 4,638,737 | A * | 1/1987 | McIngvale | 102/489 |
| 4,756,226 | A * | 7/1988 | Piesik | 89/1.8 |
| 5,014,591 | A * | 5/1991 | Porter, Jr. | 89/6 |
| 5,152,556 | A * | 10/1992 | Holland et al. | 285/353 |
| 5,164,539 | A * | 11/1992 | French | 102/520 |
| 5,226,678 | A * | 7/1993 | Petranto | 285/39 |
| 5,245,927 | A * | 9/1993 | Ranes | 102/378 |
| 5,263,418 | A * | 11/1993 | Dippold et al. | 102/509 |
| 5,280,706 | A * | 1/1994 | Yorgason | 60/255 |
| 5,358,283 | A * | 10/1994 | Silva | 285/24 |
| 6,374,744 | B1 * | 4/2002 | Schmacker et al. | 102/518 |
| 6,408,762 | B1 * | 6/2002 | Schmacker et al. | 102/382 |
| 7,101,086 | B2 * | 9/2006 | Klier | 384/273 |
| 7,261,042 | B1 * | 8/2007 | Brooks | 102/521 |

* cited by examiner

*Primary Examiner* — Michael Carone
*Assistant Examiner* — Reginald Tillman, Jr.
(74) *Attorney, Agent, or Firm* — Renner, Otto, Boisselle & Sklar, LLP

(57) ABSTRACT

Methods and apparatus for mounting a secondary system on a projectile according to various aspects of the present invention operate in conjunction with a collar. The collar is adapted to at least partially receive a fuze assembly or other projectile structure within the collar. The collar may be adapted to attach to a cover.

12 Claims, 3 Drawing Sheets

METHODS AND APPARATUS FOR ATTACHMENT ADAPTER FOR A PROJECTILE

CROSS-REFERENCES TO RELATED APPLICATIONS

Figure 1:
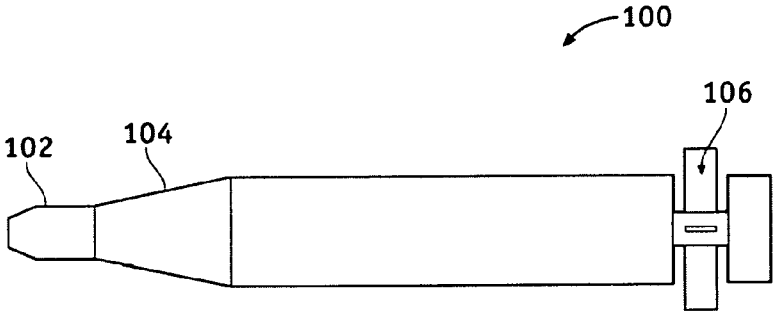

This application claims the benefit of U.S. Provisional Patent Application No. 60/943,001 filed Jun. 8, 2007, and incorporates the disclosure of the application by reference.

BACKGROUND OF INVENTION

Various surfaces are used to facilitate control of a craft's direction while in flight. The ability to control flight characteristics produces a stable flight path and permits controlled guidance of the craft. Flight controls typically include ailerons, an elevator, and a rudder. Flight controls in projectiles, however, may be as simple as using a set of tail fins in order to maintain stable flight along a desired path. Although tail fins help maintain stable flight, they are not typically used to guide the projectile towards its target.

"Smart" projectiles utilize additional control surfaces in conjunction with guidance systems to steer the projectile towards a target with greatly improved accuracy. Retrofitting existing, less expensive non-smart projectiles with guidance capabilities may expand their range of use at an overall cost savings. In some instances, a guidance kit is installed on a preexisting projectile. Though this provides increased accuracy, a retrofit may raise issues of reducing the effectiveness of the projectile.

For example, one method of adding a guidance kit to a rocket places a mounting flange between the fuze and the warhead. The guidance kit is then secured to this flange. This method, however, may compromise the integrity of fuze-to-warhead junction by introducing an air gap between the fuze and the warhead, raising concerns about reductions in the effectiveness of the projectile after the retrofitting procedure. Additionally, this method of installation results in a permanent alteration of the projectile, which may affect field operations.

SUMMARY OF THE INVENTION

Methods and apparatus for mounting a secondary system on a projectile according to various aspects of the present invention operate in conjunction with a collar. The collar is adapted to at least partially receive a fuze assembly or other projectile structure within the collar. The collar may be adapted to attach to a cover.

BRIEF DESCRIPTION OF THE DRAWING FIGURES

A more complete understanding of the present invention may be derived by referring to the detailed description and claims when considered in connection with the following illustrative figures. In the following figures, like reference numbers refer to similar elements and steps throughout the figures.

Figure 2:
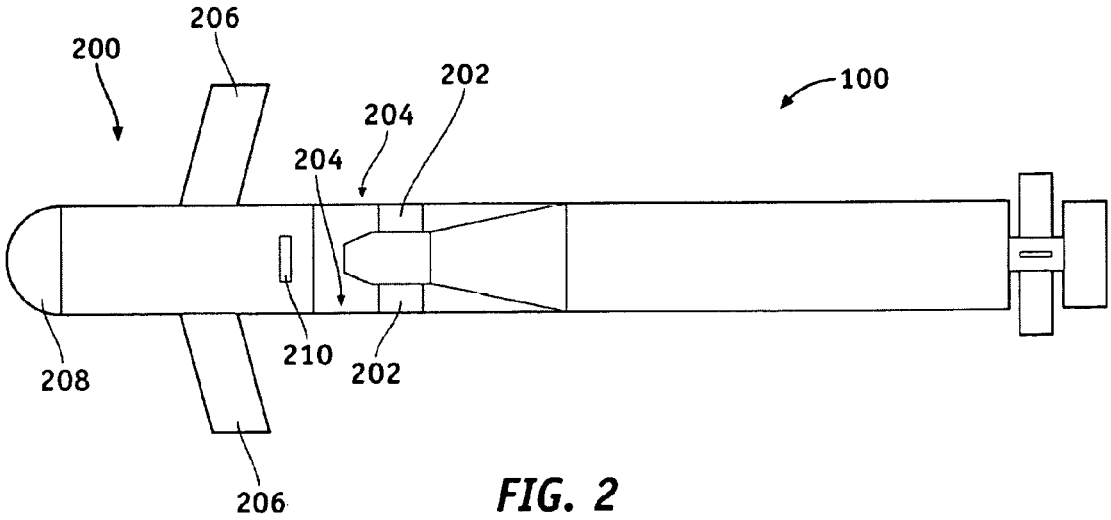
Figure 3:
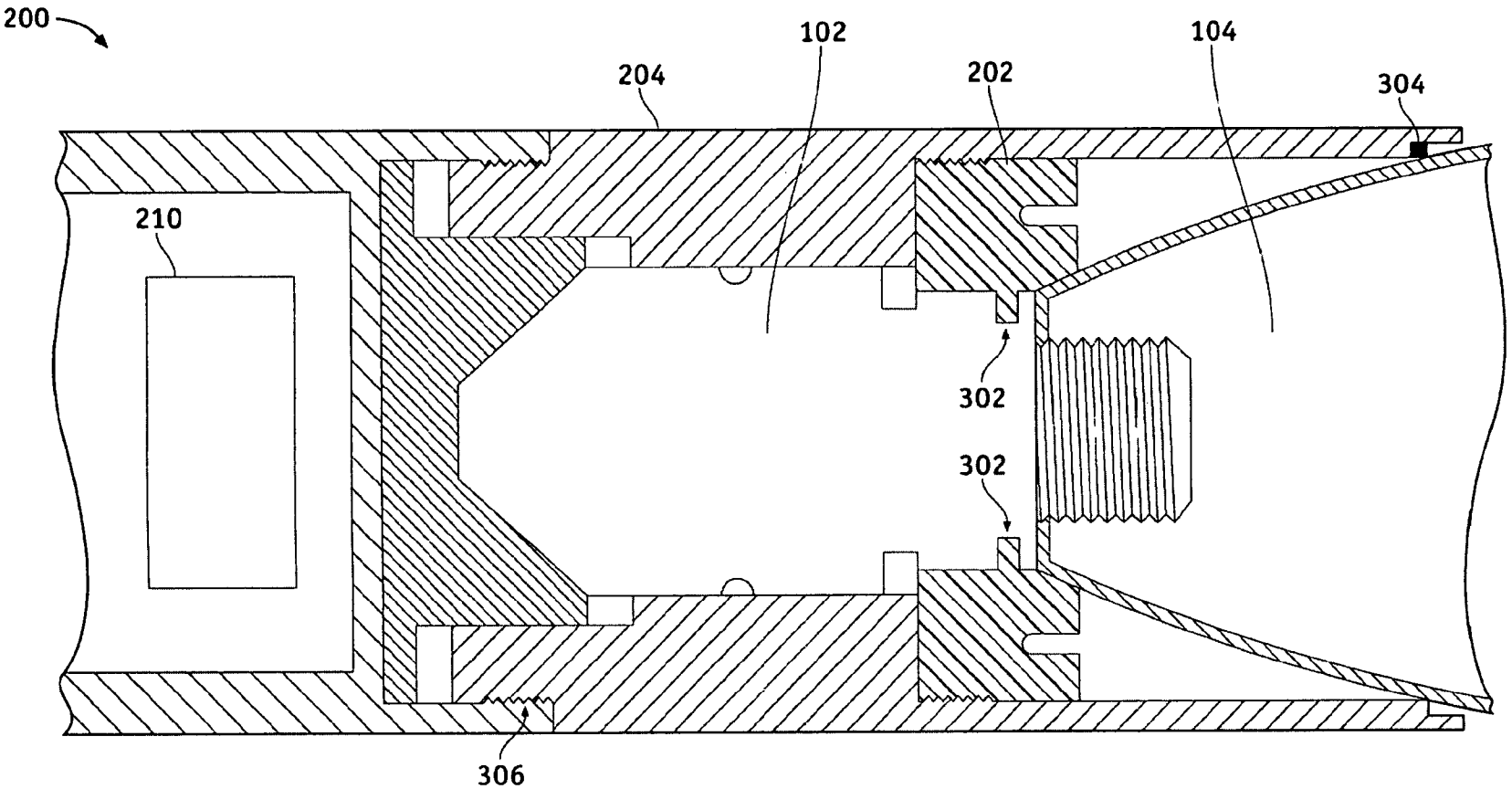
Figure 4:
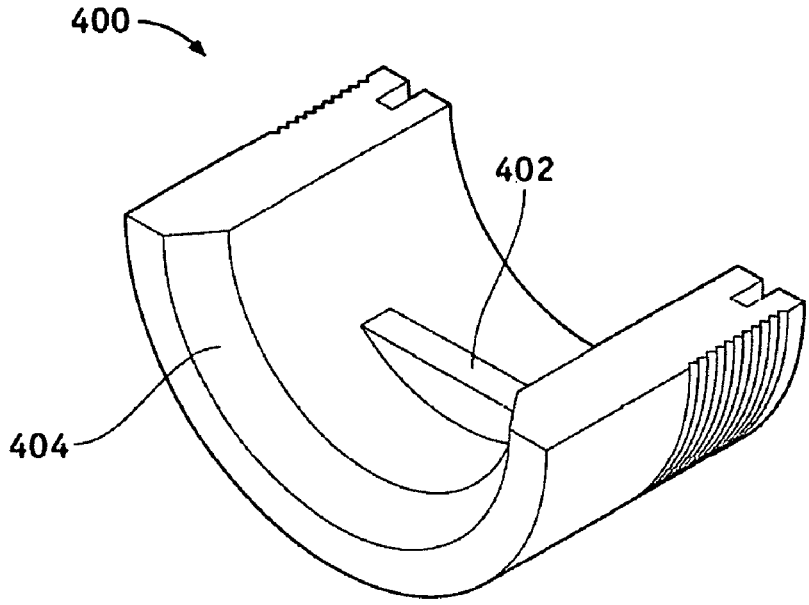
Figure 5:
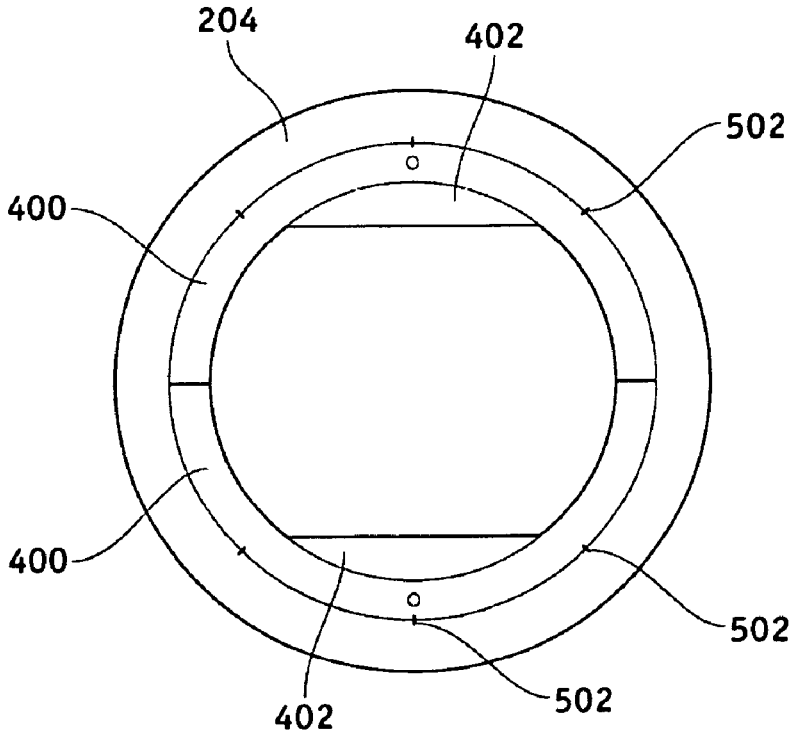

FIG. 1 representatively illustrates a projectile in accordance with an exemplary embodiment of the present invention;

FIG. 2 representatively illustrates a projectile with a guidance kit in accordance with an exemplary embodiment of the present invention;

FIG. 3 representatively illustrates a cross-sectional view of a projectile in accordance with an exemplary embodiment of the present invention;

FIG. 4 representatively illustrates one half of a collar in accordance with an exemplary embodiment of the present invention; and FIG. 5 representatively illustrates a cross-sectional view of an adapter assembly in accordance with an exemplary embodiment of the present invention.

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF EXEMPLARY EMBODIMENTS

The present invention may be described in terms of functional block components and various processing steps. Such functional blocks may be realized by any number of hardware components configured to perform the specified functions and achieve the various results. For example, the present invention may employ various housings, fittings, seals, attachment mechanisms and the like, which may carry out a variety of functions. In addition, the present invention may be practiced in conjunction with any number of ballistically fired projectiles such as countermeasures, interceptors, missiles, or rockets, and the system described is merely one exemplary application for the invention. Further, the present invention may employ any number of conventional techniques for launching or guiding projectiles, targeting objects, propulsion systems, and the like.

Various representative implementations of the present invention may be applied to any system for retrofitting projectiles. Referring now to FIG. 1, methods and apparatus for attachment adapter for a projectile according to various aspects of the present invention may operate in conjunction with a projectile 100 comprising a fuze 102 and a warhead 104. Certain representative implementations may include, for example, adding capabilities to preexisting projectiles. For example, referring now to FIG. 2, a secondary system 200 such as a guidance kit may be installed onto a projectile 100 resulting in the ability to maneuver the projectile 100 during flight. Installation of the secondary system 200 may be accomplished via a collar 202 and a surface adapter 204 suitably configured to attach the secondary system 200 to the projectile 100.

The projectile 100 comprises a moving system, for example to deliver a payload such as a warhead 104. The projectile 100 may comprise any system that is configured to travel, either with an on-board propulsion system or ballistically, such as a missile, a rocket, a bomb, or a countermeasure. The projectile 100 may also comprise additional elements such as a set of extendable tail fins 106 to provide stabilization during flight. For example, in the one embodiment, the projectile 100 may comprise a 2.75 inch diameter folding-fin aerial rocket. Various aspects of the present invention may be adapted, however, to other structures, including non-projectiles, for attaching secondary structures.

The fuze 102 acts as the detonating system to the warhead 104, which comprises the explosive or incendiary elements of the projectile 100. The fuze 102 may be configured in any manner to cause detonation of the warhead 104, e.g., a timed fuze, a contact detonator, a proximity fuze, an altitude fuze, or remote detonation. In one embodiment, the fuze 102 may comprise an M423 or M427 point-detonating fuze that is approximately four inches in length. Other representative embodiments may comprise a fuze 102 that is between two and seven inches in length.

The fuze 102 may be attached to the warhead 104 in any suitable manner such as by mechanical fasteners, a compression fitting, a mated thread design, or adhesively. Referring now to FIG. 3, in the present embodiment, the fuze 102 may further comprise notches 302 that are utilized when securing the fuze 102 to the warhead 104. For example, the notches 302 may comprise flattened sections on opposite sides of the fuze 102 that allow a wrench or similar tool to screw the fuze 102 tight against the warhead 104.

The secondary system 200 provides additional capability to a preexisting projectile 100. The secondary system 200 may comprise any system capable of adding capability to the projectile 100, such as movable control surfaces, guidance systems, targeting systems, and communication systems. Referring now to FIG. 2, an exemplary guidance kit allows the projectile 100 to be controlled during flight, increasing accuracy or reducing undesired collateral damage. The guidance kit may comprise a set of extendable control surface 206, a seeker 208, and a battery 210 for powering onboard systems.

The collar 202 fits around the fuze 102 and provides an attachment point for the surface adapter 204. The collar 202 may comprise any system that securely attaches the surface adapter 204 to the projectile 100 and may comprise any suitable material such as metal, rubber, plastic, or composite material. The collar 202 may also be of any suitable length, shape, or thickness. Securing the collar 202 around the fuze 102 rather than between the fuze 102 and the warhead 104 eliminates the air gap associated with other mounting methods and preserves the integrity of the projectile 100.

The collar 202 may comprise a single piece that is tightened around the fuze 102, such as a clamp or compression fitting, or the collar 202 may comprise multiple pieces or sections, wherein one section is mateable or interlockable with another section of the collar 202. The pieces may be secured to each other in any suitable manner, such as a hinge fitting, screws, bolts, clamps, grooves, and the like. The pieces may also be secured to each other by an external system such as the surface adapter 204.

The collar 202 may be attachable to the surface adapter 204. Any appropriate structures or mechanisms may attach the collar 202 to the surface adapter 204, such as a removable connection or a permanent connection. For example, the collar 202 may comprise mounting holes or threads along a portion of an exterior surface of the collar 202. In one embodiment, the collar 202 may comprise a series of mounting holes suitably configured to receive screws adapted to affix the surface adapter 204 to the collar 202. In another embodiment, the collar 202 may be configured with a series of threads suitably adapted to receive a matching series of threads on the surface adapter 204. In each of these embodiments, the collar 202 is locked around the fuze by the installation of the surface adapter 204.

Referring now to FIG. 4, the collar 202 may comprise two metal semicircular halves, or clamshells 400. The dimensions and shape of the collar 202 may be selected according to the dimensions and shape of other structures, such as the fuze 102, the surface adapter 204, and/or the projectile 100. In the present exemplary embodiment, the collar 202 may be a half-inch to two inches in length, such as approximately one and a quarter inches in length. The collar 202 may have an inner radius suitably sized to fit against the fuze 102 when the two clamshells 400 are mated together. The collar 202 may also configured with an outer diameter less than the outer diameter of the projectile 100 body, which allows the surface adapter 204 to be fit over the collar 202 and not extend radially beyond the surface of the projectile 100. Each clamshell 400 may further comprise a thread pattern along a portion of an exterior surface configured to receive the surface adapter 204.

The collar 202 may be further adapted to inhibit rotation and/or longitudinal sliding of the collar 202 relative to the projectile 100 and/or the fuze 102. Any appropriate connectors or structures may be included to prevent rotation, such as blocks, pins, or irregularly shaped surfaces. In the present embodiment, each clamshell 400 comprises a keyway 402 that prevents the collar 202 from sliding along or spinning about the fuze 102. Motion of the collar 202 may be prevented by configuring a portion the keyway 402 to fit inside the notch 302 of the fuze 102. The keyway 402 may comprise any system for locking the collar 202 to the fuze 102, such as a protrusion or tab placed along the inner surface of the collar 202. For example, the keyway 402 may comprise a semicircular flattened tab positioned at the center of each clamshell 400. Alternatively, the keyway 402 may comprise multiple tabs positioned at the ends of each clamshell 400. For example, the keyway 402 may comprise two quarter-circular protrusions, one positioned at each edge of the clamshell 400. The two quarter-circular protrusions may then be mated to two similar protrusions on the other clamshell 400 resulting in protrusions configured to fit inside each notch 302.

The collar 202 may also absorb and transfer maneuver loads from the surface adapter 204 to the warhead 104 section of the projectile 100. For example, the collar 202 may engage the projectile 100, such as via shoulders on the outer surface of the collar 202 where it engages the warhead 104. The shoulders may comprise any system for transferring loads from the collar 202 to the warhead 104. For example, referring to FIG. 4 of the present embodiment, the shoulders may comprise an angled surface 404 on one end of the clamshell 400. In an alternative embodiment, the shoulders may comprise a flexible element, such as a rubberized tab.

The surface adapter 204 secures the secondary system 200 to the collar 202. The surface adapter 204 may comprise any system for attachment, such as a one-piece skin configured to slide over and substantially cover the collar 202 and fuze 102, or the surface adapter 204 may comprise multiple pieces configured to be positioned around the collar 202 and the fuze 102 and then connected together, such as by connectors or bands. The surface adapter 204 may also comprise any suitable material, such a metal, composite, fiberglass, or other material capable of withstanding launch and aerodynamic related forces associated with airstream velocity over the surface of the projectile 100. For example, the surface adapter 204 may comprise the same material as the body of the projectile 100.

The surface adapter 204 may be attached to the collar 202 by any suitable structure and/or method. For example, referring to FIG. 5 of the present embodiment, the surface adapter 204 may be affixed to the collar 202 via screws 502. Referring now to FIG. 3, in another embodiment, the surface adapter 204 may slide over the fuze 102 and collar 202 and then screw onto the collar 202 via threads.

The surface adapter 204 may further comprise a mechanism for securing the secondary system 200 to the surface adapter 204. For example, referring to FIG. 3, the surface adapter 204 may comprise threads 306 that engage a matching set of threads on the secondary system 200.

The surface adapter 204 may further be configured to seal the collar 202 and the fuze 102 from the outside environment. For example, referring again to FIG. 3, the surface adapter

204 may further comprise an o-ring 304 to seal the interior volume around the fuze 102. The o-ring 304 may further be adapted to provide a tight fitting between the surface adapter 204 and the warhead 104, assist in transferring loads from the secondary system 200 to the projectile 100, and prevent unwanted movement between the surface adapter 204 and the projectile 100.

The collar 202 and surface adapter 204 may further be configured to be removed after installation. Impermanent installation may permit an unguided projectile 100 to be retrofitted with a secondary system 200 or a secondary system 200 to be removed from a previously retrofitted projectile 100 without causing operational limitations or damage to the projectile 100. Impermanent installation may also provide for use of a single secondary system 200 with various projectiles 100, depending on the specific need, application, or situation. Installation or removal of the collar 202 and surface adapter 204 may also be performed in the field without requiring special tooling. The adaptable installation method also allows for the secondary system 200 to be installed on new projectiles and removed by field personnel if the additional capability is not required.

In operation, the secondary system 200 may be affixed to the projectile 100, such as a standard unguided projectile, via the collar 202 and the surface adapter 204. The collar 202 may be fit around the fuze 102 of the projectile 100. In one embodiment, the keyway 402 of each clamshell 400 may be aligned with the notches 302 on the outer surface of the fuze 102.

The surface adapter 204 is secured around the collar 202, locking it around the fuze 102. The surface adapter 204 may be secured to the collar 202 by any suitable method. For example, in one embodiment, the surface adapter is slid over the collar 202 and secured by screws through the surface adapter 204 and into the collar 202. A secondary system 200, such as a guidance kit, may be affixed to the surface adapter 204 by any suitable method.

The projectile 100 may be placed into operation. For example, the projectile 100 may be placed into a launcher mounted to an aircraft such as a helicopter. The guidance kit may be communicatively linked to the targeting systems inside the helicopter. In this manner, the guidance kit may be used to more accurately direct the projectile 100 towards an intended target after launch.

In the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used in this description, the terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The invention claimed is:

1. A fuze assembly of a projectile, comprising:
a fuze; and
a mounting adapter that includes a collar;
wherein the fuze is partially disposed within the collar;
wherein the collar is mechanically coupled to a notch in the fuze; and
wherein the collar comprises two clamshell halves.

2. A fuze assembly according to claim 1, wherein the collar further comprises a keyway configured to couple to the collar to the fuze assembly.

3. A fuze assembly according to claim 1, wherein the collar is removably attachable to the fuze assembly.

4. A fuze assembly according to claim 1,
wherein the mounting adapter further includes a surface adapter;
wherein the surface adapter is configured to threadably attach to and substantially cover the collar; and
wherein the surface adapter is configured to receive a secondary system.

5. A fuze assembly according to claim 4,
wherein the surface adapter is removably attached to at least one of the collar, the fuze assembly, and the projectile; and
wherein the collar is configured to prevent longitudinal and rotational movement of the surface adapter.

6. A fuze assembly according to claim 1,
wherein the mounting adapter further includes a surface adapter of the mounting adapter that is mechanically coupled to the collar;
wherein the surface adapter comprises a one piece skin that mechanically fastens to the collar; and
wherein the collar is configured to prevent longitudinal and rotational movement of the surface adapter.

7. A fuze assembly according to claim 1,
in combination with other parts of the projectile;
wherein the mounting adapter further includes a surface adapter; and
wherein an exterior surface of the surface adapter has a radius substantially equal to the radius of the projectile.

8. A fuze assembly according to claim 1,
wherein the mounting adapter further includes a surface adapter; and
wherein the fuze assembly further comprises an o-ring configured to seal a junction between the surface adapter and the projectile.

9. A projectile comprising:
a warhead;
a fuze mechanically coupled to the warhead;
a secondary system forward of the warhead and the fuze; and a mounting assembly mechanically coupling the secondary system to the fuze;

wherein the mounting assembly includes a collar and a surface adapter;

wherein the collar includes at least one notch-engaging radially-inward protrusion that engages at least one notch in the fuze; and wherein the surface adapter is mechanically coupled to the collar.

10. A projectile according to claim 9, wherein the collar comprises two clamshell halves;

wherein the surface adapter covers the collar, preventing the at least one notch-engaging radially-inward protrusion from disengaging the at least one notch in the fuze.

11. A projectile according to claim 9, wherein the surface adapter has external threads that engage corresponding threads on the secondary system.

12. A projectile according to claim 9, wherein the secondary system is a guidance kit for guiding the projectile.

* * * * *